US008793814B1

(12) United States Patent
DiIanni et al.

(10) Patent No.: US 8,793,814 B1
(45) **Date of Patent: *Aug. 5, 2014**

(54) FLAME RESISTANT FABRIC MADE FROM A FIBER BLEND

(75) Inventors: William J. DiIanni, Kernersville, NC (US); Joey K. Underwood, Greenville, SC (US); Jacques A. Cantin, Greenville, SC (US)

(73) Assignee: International Textile Group, Inc., Greensboro, NC (US)

( * ) Notice: Subject to any disclaimer, the term of this patent is extended or adjusted under 35 U.S.C. 154(b) by 15 days.

This patent is subject to a terminal disclaimer.

(21) Appl. No.: 13/541,323

(22) Filed: Jul. 3, 2012

Related U.S. Application Data

(63) Continuation-in-part of application No. 12/702,848, filed on Feb. 9, 2010, now Pat. No. 8,209,785.

(51) Int. Cl.

| | |
|---|---|
| ***A41D 13/00*** | (2006.01) |
| ***A41D 27/02*** | (2006.01) |
| ***A41D 3/02*** | (2006.01) |
| *A41D 1/02* | (2006.01) |

(52) U.S. Cl.
USPC ..... 2/97; 2/272

(58) Field of Classification Search
USPC ..... 2/455, 456, 458, 69, 81, 82, 87, 93, 97, 2/272, 900
See application file for complete search history.

(56) References Cited

U.S. PATENT DOCUMENTS

| | | | |
|---|---|---|---|
| 2,939,200 | A | 6/1960 | Ewing et al. |
| 3,558,267 | A | 1/1971 | Langenfeld |
| 3,628,995 | A | 12/1971 | Economy et al. |
| 3,855,356 | A | 12/1974 | Luce |
| 3,877,974 | A | 4/1975 | Mischutin |
| 3,918,901 | A | 11/1975 | Ida et al. |
| 3,974,310 | A | 8/1976 | Mischutin |
| 4,001,477 | A | 1/1977 | Economy et al. |
| 4,129,551 | A | 12/1978 | Rueter et al. |
| 4,198,494 | A | 4/1980 | Burckel |
| 4,385,131 | A | 5/1983 | Fracalossi et al. |
| 4,525,168 | A | 6/1985 | Kelly |
| 4,554,198 | A | 11/1985 | Von Blucher et al. |

(Continued)

FOREIGN PATENT DOCUMENTS

| | | |
|---|---|---|
| EP | 0 111 124 | 6/1984 |
| EP | 0 159 876 A2 | 10/1985 |

(Continued)

OTHER PUBLICATIONS

"Advances in Military Protective Clothing Materials", presentation by the U.S. Dept. of the Army, Thomas H. Tassinari and Laurance Coffin, not dated, 16 pages.

(Continued)

*Primary Examiner* — Bobby Muromoto, Jr.

(74) *Attorney, Agent, or Firm* — Dority & Manning, P.A.

(57) ABSTRACT

Fire resistant garments are disclosed made from a fabric containing a fiber blend. The fiber blend contains meta-aramid fibers, fire resistant cellulose fibers, non-aromatic polyamide fibers, and optionally para-aramid fibers. In one embodiment, a relatively lightweight fabric is produced that has been treated with a flame resistant polymer composition. The treated fabric is particularly well suited for producing jackets and trousers that are not only flame resistant, but also offer wind resistance and water resistance.

25 Claims, 3 Drawing Sheets

(56) References Cited

U.S. PATENT DOCUMENTS

| | | | | |
|---|---|---|---|---|
| 4,594,286 | A | 6/1986 | McKinney et al. | |
| 4,666,960 | A | 5/1987 | Spain | |
| 4,705,527 | A | 11/1987 | Hussamy | |
| 4,710,200 | A | 12/1987 | Cates et al. | |
| 4,722,735 | A | 2/1988 | Brodmann | |
| 4,749,378 | A | 6/1988 | Cates et al. | |
| 4,752,300 | A | 6/1988 | Johnson | |
| 4,759,770 | A | 7/1988 | Cates et al. | |
| 4,842,609 | A | 6/1989 | Johnson | |
| 4,865,906 | A | 9/1989 | Smith, Jr. | |
| 4,868,041 | A | 9/1989 | Yamagishi et al. | |
| 4,869,947 | A | 9/1989 | Kirayoglu | |
| 4,869,953 | A | 9/1989 | Watson et al. | |
| 4,898,596 | A | 2/1990 | Riggins et al. | |
| 4,900,613 | A | 2/1990 | Green | |
| 4,911,730 | A | 3/1990 | Cates et al. | |
| 4,920,000 | A | 4/1990 | Green | |
| 4,958,485 | A | 9/1990 | Montgomery et al. | |
| 4,981,488 | A | 1/1991 | Cates et al. | |
| 4,990,368 | A | 2/1991 | Johnson et al. | |
| 4,994,317 | A | 2/1991 | Dugan et al. | |
| 5,025,537 | A | 6/1991 | Green | |
| 5,077,126 | A | 12/1991 | Green | |
| 5,136,723 | A | 8/1992 | Aldridge et al. | |
| 5,150,476 | A | 9/1992 | Statham et al. | |
| 5,191,777 | A | 3/1993 | Schnegg | |
| 5,215,545 | A | 6/1993 | Cates et al. | |
| 5,275,627 | A | 1/1994 | Cates et al. | |
| 5,306,312 | A | 4/1994 | Riggins et al. | |
| 5,316,834 | A * | 5/1994 | Matsuda et al. | 442/247 |
| 5,356,700 | A | 10/1994 | Tanaka et al. | |
| 5,388,270 | A | 2/1995 | Hewitt | |
| 5,402,362 | A | 3/1995 | Prosser | |
| 5,447,540 | A | 9/1995 | Kobayashi et al. | |
| 5,527,597 | A | 6/1996 | Stanhope et al. | |
| 5,560,990 | A | 10/1996 | Ilg et al. | |
| 5,582,912 | A | 12/1996 | McCullough, Jr. et al. | |
| 5,607,483 | A | 3/1997 | Burkinshaw et al. | |
| 5,694,981 | A | 12/1997 | Stanhope et al. | |
| 5,727,401 | A | 3/1998 | Statham | |
| 5,747,392 | A | 5/1998 | Xiao et al. | |
| 5,824,614 | A | 10/1998 | Gadoury | |
| 5,830,574 | A | 11/1998 | Gadoury | |
| 5,849,648 | A | 12/1998 | Kent et al. | |
| 5,873,914 | A | 2/1999 | Burkinshaw et al. | |
| 5,880,042 | A | 3/1999 | Schuster et al. | |
| 5,885,307 | A | 3/1999 | Gadoury | |
| 5,928,971 | A | 7/1999 | Ellis et al. | |
| 6,065,153 | A * | 5/2000 | Underwood et al. | 2/93 |
| 6,132,476 | A | 10/2000 | Lunsford et al. | |
| 6,136,892 | A | 10/2000 | Yamauchi et al. | |
| 6,192,520 | B1 * | 2/2001 | Underwood et al. | 2/93 |
| 6,194,329 | B1 | 2/2001 | Nelson et al. | |
| 6,215,545 | B1 | 4/2001 | Matsuyama | |
| 6,296,023 | B1 | 10/2001 | Gehrhardt et al. | |
| 6,341,384 | B1 | 1/2002 | Hayes | |
| 6,410,140 | B1 * | 6/2002 | Land et al. | 428/377 |
| 6,451,070 | B1 | 9/2002 | Kent et al. | |
| 6,472,456 | B1 | 10/2002 | Horsey et al. | |
| 6,481,015 | B1 | 11/2002 | Lanier | |
| 6,531,419 | B1 | 3/2003 | Wyner et al. | |
| 6,547,835 | B1 * | 4/2003 | Lunsford et al. | 8/531 |
| 6,553,749 | B2 * | 4/2003 | Land et al. | 57/5 |
| 6,562,741 | B1 | 5/2003 | Lilani | |
| 6,576,025 | B2 | 6/2003 | Lapierre | |
| 6,599,963 | B2 | 7/2003 | Horsey et al. | |
| 6,606,749 | B2 * | 8/2003 | Underwood et al. | 2/93 |
| 6,607,562 | B2 | 8/2003 | Ghorashi et al. | |
| 6,624,096 | B2 | 9/2003 | Thomas et al. | |
| 6,668,868 | B2 * | 12/2003 | Howland et al. | 139/383 R |
| 6,818,024 | B2 | 11/2004 | Lunsford et al. | |
| 6,840,967 | B1 | 1/2005 | Riggins et al. | |
| 6,867,143 | B1 | 3/2005 | Furukawa et al. | |
| 6,867,154 | B1 | 3/2005 | Lunsford et al. | |
| 6,886,184 | B2 * | 5/2005 | Underwood et al. | 2/82 |
| 6,913,720 | B2 | 7/2005 | Raponi et al. | |
| 7,008,694 | B1 | 3/2006 | Frankel | |
| 7,013,496 | B2 | 3/2006 | Dunn | |
| 7,156,883 | B2 | 1/2007 | Lovasic et al. | |
| 7,393,800 | B2 * | 7/2008 | Corner | 442/302 |
| 7,581,260 | B2 * | 9/2009 | Underwood et al. | 2/82 |
| 7,741,233 | B2 | 6/2010 | Sasser et al. | |
| 7,754,140 | B2 | 7/2010 | Rajner et al. | |
| 7,854,017 | B2 | 12/2010 | Laton | |
| RE42,209 | E | 3/2011 | Lunsford et al. | |
| 8,163,662 | B2 | 4/2012 | Dwyer | |
| 8,209,785 | B2 * | 7/2012 | Underwood et al. | 2/458 |
| 8,528,120 | B2 * | 9/2013 | Underwood et al. | 2/458 |
| 2001/0004780 | A1 | 6/2001 | Mach et al. | |
| 2002/0026663 | A1 * | 3/2002 | Underwood et al. | 2/458 |
| 2002/0124544 | A1 * | 9/2002 | Land et al. | 57/5 |
| 2003/0148689 | A1 | 8/2003 | Lapierre | |
| 2003/0167580 | A1 | 9/2003 | Lunsford et al. | |
| 2004/0034905 | A1 * | 2/2004 | Underwood et al. | 2/458 |
| 2004/0198125 | A1 * | 10/2004 | Mater et al. | 442/394 |
| 2005/0025962 | A1 * | 2/2005 | Zhu et al. | 428/359 |
| 2005/0060820 | A1 | 3/2005 | Lunsford et al. | |
| 2005/0130533 | A1 | 6/2005 | Lapierre | |
| 2005/0155131 | A1 * | 7/2005 | Underwood et al. | 2/85 |
| 2005/0208856 | A1 * | 9/2005 | McKee et al. | 442/302 |
| 2005/0277353 | A1 | 12/2005 | Lovasic et al. | |
| 2006/0068675 | A1 * | 3/2006 | Handermann et al. | 442/415 |
| 2006/0160454 | A1 * | 7/2006 | Handermann et al. | 442/415 |
| 2006/0201128 | A1 * | 9/2006 | Paire et al. | 57/210 |
| 2007/0249247 | A1 * | 10/2007 | Truesdale et al. | 442/136 |
| 2007/0249250 | A1 * | 10/2007 | Servajean | 442/184 |
| 2007/0298668 | A1 * | 12/2007 | DeFranks | 442/59 |
| 2008/0057807 | A1 * | 3/2008 | Tutterow et al. | 442/1 |
| 2008/0104743 | A1 * | 5/2008 | Ng | 2/458 |
| 2008/0113175 | A1 * | 5/2008 | Ke | 428/221 |
| 2008/0134407 | A1 | 6/2008 | Winterhalter et al. | |
| 2008/0153372 | A1 | 6/2008 | Truesdale et al. | |
| 2008/0295232 | A1 * | 12/2008 | Truesdale et al. | 2/458 |
| 2009/0049579 | A1 * | 2/2009 | Roberts | 2/81 |
| 2009/0186548 | A1 | 7/2009 | Rock | |
| 2009/0188017 | A1 * | 7/2009 | Kruse | 2/81 |
| 2010/0107443 | A1 * | 5/2010 | Aveni | 36/84 |
| 2010/0112312 | A1 * | 5/2010 | Tutterow et al. | 428/196 |
| 2011/0023206 | A1 | 2/2011 | Dunn et al. | |

FOREIGN PATENT DOCUMENTS

| | | | |
|---|---|---|---|
| EP | 0 228 026 | A2 | 7/1987 |
| EP | 0 237 451 | A1 | 9/1987 |
| EP | 0 314 244 | A2 | 5/1989 |
| EP | 0 330 163 | A2 | 8/1989 |
| EP | 0 385 024 | A1 | 9/1990 |
| EP | 0 432 100 | A2 | 6/1991 |
| EP | 0 487 568 | A1 | 6/1992 |
| EP | 0 557 734 | A1 | 9/1993 |
| EP | 0 875 620 | A1 | 11/1998 |
| GB | 2 332 001 | | 6/1999 |
| JP | 63196741 | | 8/1988 |
| JP | 2182936 | | 7/1990 |
| JP | 2221432 | | 9/1990 |
| JP | 4263646 | | 9/1992 |
| JP | 8226031 | | 9/1996 |
| JP | 9296335 | | 11/1997 |
| JP | 10060787 | | 3/1998 |
| WO | 90/06229 | A1 | 6/1990 |
| WO | 91/02837 | A1 | 3/1991 |
| WO | 93/19241 | A1 | 9/1993 |
| WO | 94/25665 | A1 | 11/1994 |
| WO | 98/12373 | A1 | 3/1998 |
| WO | 98/54399 | A1 | 12/1998 |
| WO | 99/35315 | A1 | 7/1999 |
| WO | 2009/012266 | A2 | 1/2009 |
| WO | 2009/012266 | A9 | 1/2009 |

OTHER PUBLICATIONS

"Aramid fibres", J.E. McIntyre, Rev. Prog. Coloration, vol. 25, 1995, pp. 44-56.

(56) References Cited

OTHER PUBLICATIONS

"Clothing for Work and Protection", R. Jeffries, Lenzinger Berichte, Aug. 1989, pp. 25-33.
"Demand Heats Up", Doug Jackson, Safety & Protective Fabrics, Sep. 1992, pp. 32-35.
"Flame Retardant Viscose Rayon Containing a Pyrophosphate", Rainer Wolf, Ind. Eng. Chem. Prod. Res. Dev., 1981, vol. 20, pp. 413-420.
"In the heat of combat, Flame-Resistant, Protective Apparel of NOMEX gives you a fighting chance", DuPont NOMEX Brochure, 1996, 8 pages.
"Measuring the Effects of intense Heat and Dynamic Mechanical Forces on Thermal Protective Fabrics", Geshury et al., High-Tech Fibrous Materials, ACS Symposium Series, American Chemical Society, 1991, pp. 278-292.
DuPont NOMEX IIIA brochure, 1994, 5 pages.
DuPont NOMEX Laundering Guide, 1997, 22 pages.
Technical Guide for NOMEX Brand Fiber, 2001, 40 pages.
"Novel Approach to Soldier Flame Protection" Presentation by U.S. Army Natick Soldier Center. Winterhalter and Martin, 2011, 22 pages.
Novel Polymer Solutions, http://www.novelpolymers.co.uk, at least as early as Apr. 12, 2011, 2 pages.
"Novel Approach to Soldier Flame Protection", Winterhalter et al., Journal of ASTM International, Feb. 2005, Fol. 2, No. 2, pp. 227-234.
DuPont KARVIN brochure, not dated, 4 pages.
"Printing Technology for Aramid Fabrics", Hodge et al., High-Tech Fibrous Materials, ACS Symposium Series, American Chemical Society, 1991, pp. 270-276.
"Properties and Processing Guidelines for Lenzing FR", not dated, 21 pages.
"Protective Clothing of DuPont NOMEX and Heat Stress", brochure, 2000, 2 pages.
"The Dyeing, Finishing and Performance of Fabrics for Military Uniforms", John V. Morris, Rev. Prog., Coloration, vol. 11. 1981, pp. 9-18.
TL 8415-0235, 2008, 21 pages.
"Dyeing and Finishing of KARVIN", Sep. 1982, 7 pages.
"The Processing of KARVIN in Modified Cotton Spinning and in Weaving Mills", Sep. 1982, 6 pages.
"Yarns, Fabrics and Garments made with KARVIN", Sep. 1982, 13 pages.
International Search Report, PCT/US2011/023955, mailed Jul. 15, 2011.
International Preliminary Report on Patentability, PCT/US2011/023955, mailed Aug. 14, 2012.

* cited by examiner

FIG. –1–

FLAME RESISTANT FABRIC MADE FROM A FIBER BLEND

RELATED APPLICATIONS

The present application is a continuation-in-part application of U.S. patent application Ser. No. 12/702,848, filed on Feb. 9, 2010, which is incorporated herein by reference.

BACKGROUND

Military personnel are issued and wear many different types of clothing items depending upon the actions they are performing, the climate they are working in, and based on various other factors. Such clothing items can include, for instance, pants, shirts, coats, hats, jackets, and the like. The clothing items are intended not only to keep the wearer warm and sheltered from the elements but to also provide protection, especially in combat areas.

In the relatively recent past, the United States military has designed a garment or clothing system that includes multiple articles of clothing and garments. In one embodiment known as the extended cold weather clothing system (abbreviated ECWCS), the garment system includes seven separate layers or "levels" of clothing, wherein each layer and garment is configured to function alone or to be used in conjunction with the other articles of clothing in the system. The clothing system as described above is intended to be used in a broad climate range from very cold temperatures down to −40° F. to higher temperatures of about 60° F. The clothing system is designed such that the wearer can selectively pick and choose which clothing items to don depending upon the environmental conditions.

The extended cold weather clothing system generally includes the following layers or levels:

Level 1: Light-weight undershirt and long underwear
Level 2: Mid-weight shirt and heavier long underwear
Level 3: High-loft fleece jacket
Level 4: Wind jacket designed for wear under body armor
Level 5: Soft shell jacket and trousers providing wind resistance and water resistance
Level 6: Extreme wet/cold weather jacket and trousers having waterproof shell layer
Level 7: Extreme cold weather parka and trousers As shown above, certain garments in the above clothing system are designed to be wind resistant and/or water resistant while remaining lightweight, such as the Level 4 layers and the Level 5 layers. In the past, the fabric used to produce the Level 5 articles of clothing comprised a densely woven fabric made of nylon filaments. A silicone coating was also applied to the fabric. Such fabrics have very good wind resistance and water resistance features and are breathable. The fabrics are also lightweight, packable and quiet.

Recently, greater attention has been focused on developing garments for military personnel that have fire resistant properties. The fire resistant properties are intended to protect the wearer when exposed to flash fires. The push to increase the fire resistant properties of clothing worn by military personnel is primarily in response to the various different types of incendiary devices that military personnel may be exposed to in the field.

In the past, in order to produce fabrics having fire resistant properties, the fabrics were typically made from inherently flame resistant fibers. Such fibers, for instance, may comprise aramid fibers such as meta-aramid fibers or para-aramid fibers. Such fibers, for instance, are typically sold under the trade names NOMEX® or KEVLAR® or TVVARON®. The use of inherently flame resistant fibers to produce garments, such as those worn by military personnel, are disclosed in U.S. Pat. No. 4,759,770, U.S. Pat. No. 5,215,545, U.S. Pat. No. 6,818,024, U.S. Pat. No. 7,156,883, U.S. Pat. No. 4,981,488 and U.S. Pat. No. 6,867,154 which are all incorporated herein by reference.

Although the use of inherently flame resistant fibers can produce garments having excellent flame resistant properties, the above fibers do have some disadvantages and drawbacks. For example, the fibers are relatively expensive. The fabrics also do not have favorable moisture management properties for many applications. Fabrics made from inherently flame resistant fibers are also difficult to dye and/or print, thus making it difficult to apply a camouflage pattern to the fabrics.

Another drawback to the use of inherently flame resistant fibers is that the fibers are typically produced in staple form and thus are spun into yarns. Spun yarns generally take up greater volume or space at the same weight per unit length as filament yarns. Thus, fabrics made from spun yarns typically do not provide the same wind resistance protection and water resistance protection as fabrics made from nylon filaments as described above. The spun yarns tend to be coarse which result in an open fabric construction.

In view of the above, a need currently exists for a garment that is lightweight, provides wind and water resistance, and also has excellent flame resistant properties.

SUMMARY

In general, the present disclosure is directed to a lightweight fabric that is not only wind resistant and water resistant, but is also flame resistant. The lightweight fabric can be used to make all different types of clothing items and garments. In one embodiment, for instance, the lightweight fabric is used to produce a jacket and/or trousers. The jacket or trousers may be part of an overall clothing system, such as an extended cold weather clothing system wherein the jacket and trousers comprise an intermediate layer.

The flame resistant fabric can be made from a fiber blend. The fiber blend may include inherently flame resistant fibers in combination with flame resistant cellulose fibers. The cellulose fibers, which may be rayon fibers, can be configured to absorb moisture and wick away perspiration. The cellulose fibers, and particularly rayon fibers, also improve the drape characteristics of the fabric, provide a softer hand, and can reduce noise when the fabric is worn as a garment. In one embodiment, the fiber blend can further contain polyamide fibers, such as nylon fibers. The nylon fibers are present in the blend in an amount sufficient to dramatically increase the durability of the fabric without adversely impacting any of the other properties of the fabric, especially the fire resistant properties of the fabric.

In one embodiment, for instance, the present disclosure is directed to a garment with flame resistant properties. The garment has a shape to cover at least a portion of the wearer's body and is made from a woven fabric containing a plurality of yarns. The yarns are made from a plurality of fibers. The plurality of fibers include, in one embodiment, meta-aramid fibers in an amount from about 30% to about 60% by weight of the fabric; flame resistant cellulose fibers in an amount from about 20% to about 50% by weight of the fabric; nylon fibers in an amount from about 12% to about 25% by weight of the fabric; and optionally para-aramid fibers in an amount up to about 15% by weight of the fabric. For instance, in one embodiment, the fabric may contain para-aramid fibers in an amount from about 3% to about 15% by weight of the fabric.

The yarns used to create the fabric can be made from an intimate blend of the above described fibers.

The flame resistant cellulose fibers contained within the fabric may comprise cellulose fibers that have been pretreated with a fire resistant composition. The cellulose fibers may comprise, for instance, cotton fibers, rayon fibers, mixtures thereof, or the like. The flame resistant composition may contain, for instance, a phosphorous compound or a halogen compound.

As described above, the fabrics made in accordance with the present disclosure can be relatively lightweight and can be wear resistant. For instance, the fabric (without treatments, finishes or coatings) can have a basis weight of less than about 5 osy, such as from about 2 osy to about 5 osy.

In addition to having a relatively light weight, the fabric can also be constructed such that the yarns are tightly woven together. For instance, the yarns in the warp direction and the yarns in the fill direction can have a yarn density of greater than about 45 yarns per inch. In one embodiment, the yarn density in both directions can be from about 45 yarns per inch to about 95 yarns per inch, such as from about 45 yarns per inch to about 60 yarns per inch.

In order to increase wind resistance and water resistance, the fabric can be treated with a flame resistant polymer composition. The flame resistant polymer composition can be applied to the fabric in liquid form (as opposed to being laminated to a film) and dried such that the flame resistant polymer composition has a weight on the fabric of from about 0.25 osy to about 2 osy, and particularly from about 0.75 osy to about 1.5 osy. In one embodiment, the flame resistant polymer composition contains a polyurethane polymer.

In one embodiment, the flame resistant fabric treated with the flame resistant polymer composition may have an air permeability of less than about 5 cfm, and particularly less than about 1 cfm when tested according to ASTM Test D 737. The treated fabric may have a water permeability when tested according to Test AATCC 127 of greater than about 20 cm. The fabric can have the above characteristics while still having a moisture vapor transmission rate of greater than about 600 $g/m^2/24$ hrs when tested according to ASTM Test E 96B.

When tested according to the Vertical Flame Test according to ASTM Test D 6413, the fabric can have a char length of less than about 4.5 inches in either the warp direction or the fill direction. The treated fabric can have a breaking strength of greater than about 140 lbs. (ASTM D 5034) in the warp direction and can have a tear strength of greater than about 4.5 lbs., such as greater than about 5 lbs. (ASTM D 1424) in the warp direction.

In one embodiment, the fabric can also be treated with a durable water resistant finish. In yet another embodiment, instead of treating the fabric with the flame retardant polymer composition, the fabric can be laminated to a film. The film may comprise a polyurethane film or a fluoropolymer film, such as an expanded polytetrafluoroethylene film.

The yarn sizes used to create the fabric can vary depending upon the particular application. In general, the yarns may comprise spun yarns having a count of from about 40/1 to about 15/1.

Garments made according to the present disclosure have numerous applications. The garments, for instance, are particularly well suited for being worn by those in the military or those having jobs relating to public safety, such as firemen and policemen. The garments made according to the present disclosure are also particularly well suited for use in industrial settings. When designed for military applications, the garments can be printed with a camouflage pattern that may be difficult to detect using night vision goggles.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figure, in which.

Figure 1:
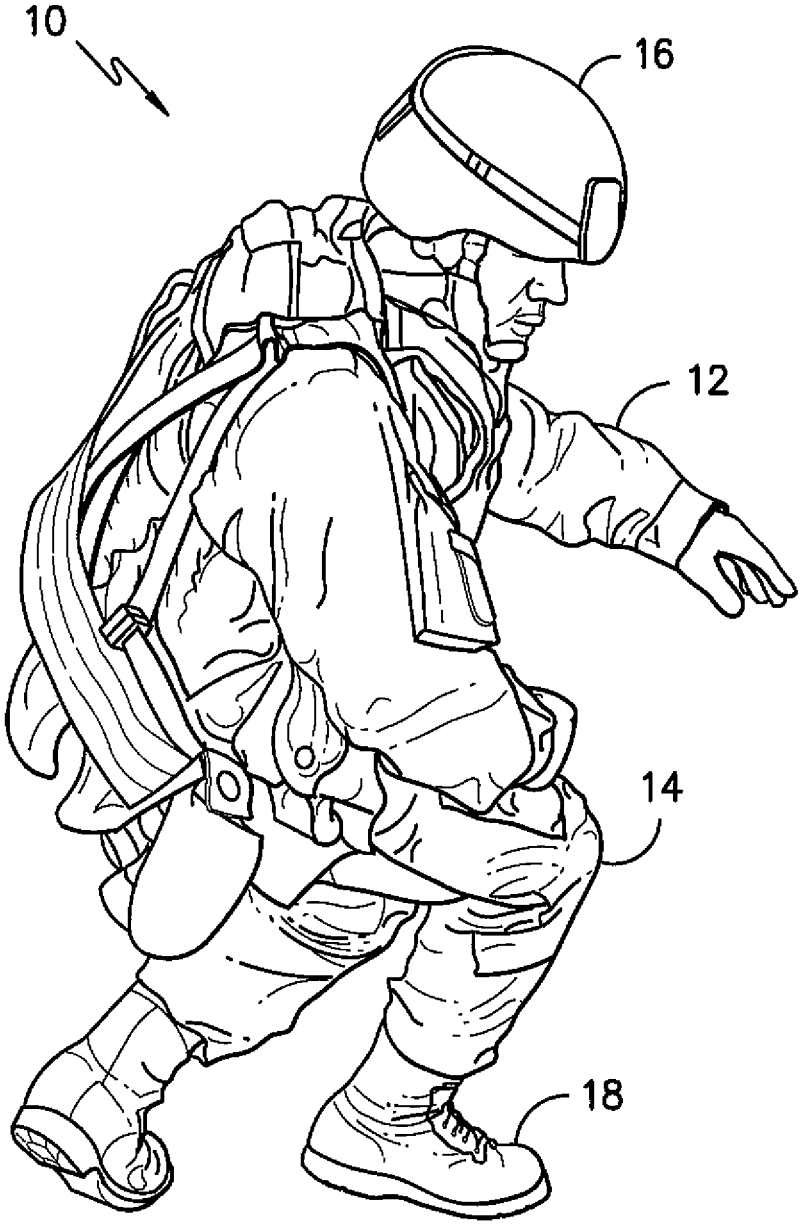
FIG. 1 is a perspective view of one embodiment of a garment made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

In general, the present disclosure is directed to a relatively lightweight fabric that has excellent flame resistant properties. In one embodiment, the fabric may be treated with a flame retardant polymer composition that improves the water and wind resistance properties of the fabric while maintaining a high level of breathability. Further, the composition can be applied to the fabric without compromising the flame resistant properties of the fabric.

In one embodiment, the lightweight fabric of the present disclosure is used to produce various articles of clothing. In one particular embodiment, for instance, the lightweight fabric may be used to produce a jacket and/or trousers. The jacket and/or trousers may be used in a clothing system, such as in an extended cold weather clothing system as used by the military. The jacket and/or trousers may be used as an intermediate layer in the clothing system.

In one embodiment, the fabric is made from a blend of fibers that, when blended in certain relative amounts, results in a fabric having a broad spectrum of desirable properties.

For instance, fabrics made in accordance with the present disclosure have excellent strength properties, improved fire resistant properties in comparison to many commercially available fabrics, have excellent hand, are more abrasion resistant than many prior art fabrics, have excellent break open properties, and have excellent shrinkage control properties.

As described above, the flame resistant fabric of the present disclosure generally contains a blend of fibers. The blend of fibers includes inherently flame resistant fibers and cellulose fibers. The cellulose fibers, for instance, can comprise cellulose fibers that have been pretreated with a flame resistant composition to make the fibers flame retardant. There are many advantages and benefits to combining inherently flame resistant fibers with flame resistant cellulose fibers. Combining flame resistant cellulose fibers with inherently flame resistant fibers, for instance, can produce fabrics that are generally more comfortable to wear. The fabrics can also have better drape properties and surface texture. In addition, the fabrics can be easier to dye and may more readily accept a printed pattern.

In this regard, in the past, various different fabrics have been proposed that include a combination of inherently flame resistant fibers and flame resistant cellulose fibers. For instance, such fabrics are disclosed in U.S. Pat. No. 4,981,488, U.S. Pat. No. 6,867,154 and U.S. Pat. No. 7,156,833, which are all incorporated herein by reference.

In one embodiment, in addition to inherently flame resistant fibers and flame resistant cellulose fibers, fabrics according to the present disclosure can also contain non-aromatic polyamide fibers, such as nylon fibers. When the above fibers are combined with other fibers according to carefully controlled ratios, a flame resistant fabric can be produced that has a broad spectrum of excellent properties, including durability.

In one embodiment, the inherently flame resistant fibers contained in the fiber blend comprise meta-aramid fibers. Optionally, other inherently flame resistant fibers may be present in the blend, such as para-aramid fibers. When present, the para-aramid fibers are added in amounts much less than the meta-aramid fibers. For instance, the para-aramid fibers may be present in an amount less than about 15% by weight, such as from about 3% to about 15% by weight. The para-aramid fibers can be present in an amount sufficient to reduce shrinkage of the fabric and to provide greater strength to the fabric. The amount of para-aramid fibers, however, can be minimized in order to maintain a lower cost. Para-aramid fibers are available from numerous commercial sources. In one embodiment, for instance, the para-aramid fibers may comprise fibers sold under the trade name KEVLAR® available from E.I. duPont de Nemours and Company.

As described above, in one embodiment, most of the inherently flame resistant fibers present in the fiber blend comprise meta-aramid fibers, which are also known as fibers comprised of poly (metaphenylene isophthalamide). Meta-aramid fibers are available from numerous commercial sources. For instance, in one embodiment, the meta-aramid fibers may comprise NOMEX® fibers sold by E.I. duPont de Nemours and Company. The meta-aramid fibers are present in the fiber blend in an amount of at least about 30% by weight, such as from about 30% by weight to about 60% by weight. In one embodiment, for instance, the meta-aramid fibers are present in the fiber blend in an amount from about 40% to about 50% by weight. When present in the above amounts, the meta-aramid fibers provide the resulting fabric with significant flame resistant properties.

The meta-aramid fibers contained in the fabric can be substantially amorphous, crystalline, or a mixture of both. Amorphous meta-aramid fibers, for instance, generally have a crystallinity of less than about 10%. Crystalline fibers, on the other hand, generally have a crystallinity of greater than 10%, such as greater than 25%, such as having a crystallinity of from about 25% to about 40%.

Other inherently flame resistant fibers that may be present in the fabric include polybenzimidazole fibers. One embodiment of such fibers is known in the art as PBI fibers. The PBI fibers may be present alone or in combination with the above described aramid fibers.

The fiber blend can also contain flame resistant cellulose fibers. As used herein, flame resistant cellulose fibers refers to cellulose fibers that have been treated with a flame resistant composition or flame retardant. The inclusion of cellulose fibers in the fiber blend can make the resulting fabric softer, more breathable, and less expensive. Examples of flame resistant cellulose fibers that may be incorporated into the fabric include FR cotton, FR rayon, FR acetate, FR triacetate, FR lyocell, and mixtures thereof. In one particular embodiment, FR rayon fibers are incorporated into the fiber blend. FR rayon fibers are available from various different sources. FR rayon fibers, for instance, are sold under the name LENZING® by Lenzing Fibers of Austria. LENZING FR fibers are viscous fibers that have been treated with a flame resistant composition. In one embodiment, the flame resistant rayon fibers are made by spinning reconstituted cellulose from beech trees. Such fibers are more water absorbent than cotton fibers.

The amount of flame resistant cellulose fibers present in the fiber blend may depend upon various different factors and the particular application. In one embodiment, for instance, the flame resistant cellulose fibers may be present in the fiber blend in an amount from about 20% to about 50% by weight. In one particular embodiment, for instance, the flame resistant cellulose fibers may be present in the fiber blend in an amount from about 30% to about 35% by weight. At the above weight percentages, the cellulose fibers provide the advantages described above without significantly impacting flame resistance.

As described above, flame resistant cellulose fibers comprise fibers that have been treated with a flame resistant composition. The flame resistant composition can be incorporated into the fibers using various methods and techniques. For instance, the flame resistant composition can be incorporated into the fibers during spinning, can be coated on the fibers, or can be absorbed into the fibers. The flame resistant composition may contain, for instance, a phosphorus compound, a halogen compound, or any other suitable flame resistant agents.

In addition to the above fibers, the fiber blend of the present disclosure can further contain fibers that increase the durability of the fabric. For instance, in one embodiment, non-aromatic polyamide fibers may be incorporated into the fiber blend, such as nylon fibers. The amount of non-aromatic polyamide fibers incorporated into the fiber blend can be carefully controlled so as to maintain the desirable flame resistant properties of the fabric while increasing the durability of the fabric, namely the abrasion resistance. In this regard, the non-aromatic polyamide fibers may be present in the fiber blend in an amount from about 12% to about 25% by weight, and particularly from about 15% to about 20% by weight.

Of particular importance, in one embodiment, the non-aromatic polyamide fibers are substantially pure and contain no other fillers or other ingredients. Using substantially pure non-aromatic polyamide fibers, for instance, has been found to dramatically improve the abrasion resistance of the fabric if controlled within the above described amounts. When added in the above described amounts, the non-aromatic polyamide fibers also do not substantially compromise the flame resistant properties of the overall fabric. In one embodiment, the fabric can have a taber abrasion resistance of at least about 1000 cycles when tested according to ASTM Test No. D3884 (2007 version using wheel H18 with a 500 gram weight). For instance, the fabric can have a taber abrasion resistance of at least about 1200 cycles, at least about 1300 cycles, at least about 1500 cycles, or even at least about 1700 cycles when tested according to the above described standards. Of particular advantage, the above abrasion resistance characteristics can be obtained on fabrics having a basis weight less than about 8 osy, such as less than about 7 osy, such as from about 2 osy to about 6 osy.

In the past, those skilled in the art have been reluctant to incorporate synthetic fibers, such as nylon fibers, into flame resistant fabrics, especially flame resistant fabrics for use by military personnel. Such synthetic fibers, for instance, have a tendency to melt and drip when exposed to an open flame. The present Inventors discovered, however, that the abrasion resistance of the fabric can be dramatically improved without the above disadvantages occurring at any unacceptable levels when the amount of the fibers are carefully controlled in conjunction with the proportions or amounts of the other fibers.

The fiber blend as described above is used to form yarns that are then woven or knitted into a fabric. In one embodiment, the fiber blend is made of substantially staple fibers, which are fibers having a determined length. The staple fibers, for instance, may have lengths of less than about 5 inches in one embodiment. When using staple fibers, the resulting yarns are spun from the fiber blend. Although each yarn may be made from a different type of fiber, in one embodiment, the yarns are all made from an intimate blend of the mixture of fibers.

In addition to staple fibers, all or some of the yarns may also be made from continuous fibers, such as filaments. The yarns, for instance, can have a yarn count between about 8 and about 55.

Once the yarns are constructed, the yarns can be woven into any suitable fabric. In general, the fabric may have a basis weight of less than about 9 osy. For instance, the fabric may have a basis weight of from about 2 osy to about 9 osy, such as from about 4 osy to about 7 osy, and in one embodiment, from about 5 osy to about 6 osy. The weight of the fabric, however, may depend upon the type of garment to be produced.

In one embodiment, a fabric is produced that has a relatively light weight. In this embodiment, the fabric may have a basis weight of less than about 5 osy, such as from about 2 osy to about 5 osy, such as from about 3 osy to about 4.5 osy.

In one embodiment, fabrics of the present disclosure can be constructed so as to be wind resistant. In this embodiment, relatively small sized yarns can be used to construct the fabric. In addition to using smaller sized yarns, the fabric can also be produced having a relatively dense weave.

For example, in one embodiment, the yarn sizes can be from about 40/1 to about 15/1, such as from about 30/1 or 4012 to about 15/2. In one particular embodiment, the yarn sizes may be about 36/2 or 3011.

The yarn density within the weave, on the other hand, can generally be greater than about 45 yarns per inch in both the warp direction and the fill direction. For instance, the yarn density in the warp direction and the fill direction can be from about 45 yarns per inch to about 110 yarns per inch, such as from about 45 yarns per inch to about 95 yarns per inch, such as from about 45 yarns per inch to about 60 yarns per inch. In other embodiments, the yarn density can be greater than about 50 yarns per inch, such as greater than about 55 yarns per inch, such as greater than about 60 yarns per inch.

When producing a woven fabric, the fabric can have any suitable weave. For instance, the fabric can have a plain weave, a twill weave, or a rip stop weave. In one embodiment, however, the fabric can be made with a herringbone weave. Using a herringbone weave can improve some of the properties of the fabric. The herringbone weave, for instance, increases the tear properties of the fabric and increases the porosity of the fabric. In fact, the porosity of the fabric can be improved to an extent that a wearer will noticeably be more comfortable in the fabric, especially when exposed to certain environmental conditions.

After the fabric is woven, in one embodiment, the fabric can be treated with a flame resistant polymer composition. As used herein, a treatment refers to applying a liquid (which includes solutions, emulsions, dispersions, and suspensions) to a textile substrate for coating the fibers. A surface treatment is different than laminating the fabric to a film. In some treatments, a film is formed on the surface of the fabric. In other treatments, however, only the fibers are coated and thus the treatment does not form a continuous film on the surface of the fabric.

In accordance with the present disclosure, the fabric can be treated with a flame resistant polymer composition in order to further improve wind resistance and water resistance without compromising the flame resistant properties. In one embodiment, the flame resistant polymer composition contains a polyurethane polymer. The polyurethane polymer may be formulated to be flame resistant or may be combined with flame retardants, such as a halogen and/or a phosphorus compound.

The flame resistant polymer composition can be applied to the fabric so as to have a dried weight on the fabric of from about 0.25 osy to about 2 osy, such as from about 0.75 osy to about 1.5 osy.

In one embodiment, the flame resistant polymer composition may comprise a polyurethane, an aromatic compound containing halogen, antimony oxide, barium metaborate monohydrate, or mixtures thereof, and a metal hydroxide or mineral hydride. For instance, the polymer composition may contain polyurethane in an amount from about 35% to about 50% by weight, decabromodiphenyl ether or ethylene-bis-tetrabromophthalimide in an amount from about 10% to about 30% by weight, barium metaborate monohydrate in an amount from about 2% to about 10% by weight, and aluminum hydroxide in an amount from about 2% to about 10% by weight.

The polymer composition can be prepared by mixing the above components in the presence of a solvent. The solvent may be an aqueous solvent or a non-aqueous solvent. The polymer composition can then be applied to the surface of the fabric using any suitable coating process, such as using a knife blade or a table coater. Once applied, the coating is dried and cured. Flame retardant polymer coatings that may be used in accordance with the present disclosure, for instance, are disclosed in U.S. Pat. No. 7,666,802, which is incorporated herein by reference.

Once treated with the flame resistant polymer composition, the treated fabric may have excellent wind resistant properties. For instance, the fabric may have an air permeability of less than about 5 cfm, such as less than about 3 cfm, such as less than about 1 cfm.

In addition, the treated fabric can also have excellent water resistant properties. For instance, the treated fabric may display a water permeability according to Test AATCC 127 of greater than about 20 cm, such as from about 20 cm to about 30 cm.

Even after being treated with the flame resistant polymer composition, the fabric can also be highly breathable. For instance, treated fabrics according to the present disclosure can have a moisture vapor transmission rate of greater than about 600 $g/m^2/24$ hrs, such as greater than about 800 $g/m^2/24$ hrs, such as even greater than about 1000 $g/m^2/24$ hrs. The moisture vapor transmission rate is generally less than about 3000 $g/m^2/24$ hrs when tested according to Test Method ASTM E 96 Procedure B.

In addition to and instead of being treated with a flame resistant polymer composition, the fabric can also be treated with various other compositions. For instance, in one embodiment, the fabric can be treated with a durable water resistant treatment. The durable water resistant treatment may comprise, for instance, a fluoropolymer. Other treatments that may be applied to the fabric include insect repellants and/or a moisture management finish.

Many different types of durable water resistant treatments may be applied to the fabric. In one embodiment, the durable water resistant treatment forms a finish (as opposed to a coating) on the fabric. The durable water resistant treatment can be applied to the fabric by treating the fabric with a bath containing the treatment, padding the composition into the fabric, placing the fabric on a tenter frame, and heating the fabric in order to evaporate all volatiles. During the process, the durable water resistant treatment may be applied to the fabric in an amount from about 0.5% to about 10% by weight, such as from about 1% to about 5% by weight.

In many applications, the durable water resistant treatment may comprise a fluoropolymer. Particular durable water resistant treatments that may be applied to the fabric in accordance with the present disclosure are discussed in greater detail below.

In one embodiment, the DWR comprises at least one member selected from the group consisting of a perfluoroalkyl group-containing substance, a fluorine-containing surfactant, a fluorine-containing oil, a fluorosilicone oil and a silicone oil. Preferably the fluorine-containing resin derives from an aqueous dispersion or dissolving in a solvent. Preferably, the fluorine-containing resin comprises a fluororesin or a mixture of a fluororesin and some other resin. Preferably, the fluororesin is a copolymer of a fluoroolefin and a vinyl monomer. Preferably, the fluororesin is a copolymer of fluoroolefins. Preferably, the copolymer of fluoroolefins is a copolymer of vinylidene fluoride and a fluoroolefin other than vinylidene fluoride.

In another embodiment, a durable water/soil-resistant fluoropolymer is selected from those groups that will provide the necessary water/soil resistance and can be polymerized. Examples include fluorinated monomers of acrylates, methacrylates, alkenes, alkenyl ethers, styrenes, and the like. Monomers that contain carbon-fluorine bonds that are useful include, but are not limited to, Zonyl TA-N (an acrylate from DuPont), Zonyl TM (a methacrylate from DuPont), FX-13 (an acrylate from 3M), and FX-14 (a methacrylate from 3M) or UNIDYNE TG581 (a $C_6$ fluoropolymer available from Daikin). The fluoropolymers may include —CF 3 and —CHF 2 end groups, perfluoroisopropoxy groups (—OCF(CF 3) 2), 3,3,3-trifluoropropyl groups, and the like. The polymers may include vinyl ethers having perlluorinated or partially fluorinated alkyl chains. The fluoropolymer preferably comprises one or more fluoroaliphatic radical-containing monomers. Monomers used to form the fluoropolymer may be based upon 6 carbon chain chemistry or 8 carbon chain chemistry.

In another embodiment, the DWR comprises a repellent and a fluorine-containing resin, wherein the repellent comprises an esterification reaction product (I-3) from a perfluoroalkyl group-containing compound (I-3-1) and a compound (I-3-2) containing a phosphoric acid group as a functional group, and the fluorine-containing resin derives from an aqueous dispersion. Preferably, the fluorine-containing resin comprises a fluororesin or a mixture of a fluororesin and some other resin. Preferably, the other resin is an acrylic resin. Preferably, the fluororesin is a copolymer of a fluoroolefin and a vinyl monomer. Preferably, the fluororesin is a copolymer of fluoroolefins. Preferably, the copolymer of fluoroolefins is a copolymer of vinylidene fluoride and a fluoroolefin other than vinylidene fluoride. Preferably, the fluorine-containing resin comprises a fluororesin obtained by seed polymerization of an acrylic resin.

Commercially available DWR not mentioned above that may be used in the present disclosure include fluoropolymer compositions sold under the name MILEASE® by Clariant, fluorochemicals sold under the tradename TEFLON® or Capstone® by DuPont, fluorochemicals sold under the by tradename ZEPEL® also by DuPont, or fluorocarbon polymers sold under the tradename REPEARL® by the Mitsubishi Chemical Company or fluorocarbon polymers sold under the tradename UNIDYNE® by the Daikin Company.

In one embodiment, if desired, an isocyanate may be present in conjunction with a fluorochemical, such as a fluoropolymer. The isocyanate may comprise a blocked isocyanate that is a formaldehyde-free cross-linking agent for fluorochemical finishes. The blocking agent may comprise a phenol or any other suitable constituent.

In another embodiment, the fabric can be laminated to a film. By laminating a film to the fabric, the resulting laminate may have an air permeability of 0 cfm. The film may comprise polytetrafluoroethylene or a polyurethane. For instance, in one embodiment, an expanded polytetrafluoroethylene (ePTFE) may be used. The film may have a thickness of generally from about 1 micron to about 25 microns, such as from about 10 microns to about 25 microns.

The film layer may be adhered to the outer shell using any suitable technique or method. In one embodiment, for instance, an FR adhesive may be used to laminate the film to the fabric.

By incorporating the film layer into the composite fabric product, the outer shell not only becomes water resistant but also waterproof. In exchange, the breathability of the outer shell may be reduced. For instance, the breathability may be from about 400 $g/m^2/24$ hrs to about 600 $g/m^2/24$ hrs.

Fabrics made according to the present disclosure can be dyed and/or printed prior to or after being formed into a garment. Further, the fibers used to form the fabric can be producer dyed or non-producer dyed depending upon the application.

In one particular embodiment, the fabric can be woven or knitted and then dyed a particular base shade. Once dyed, any suitable pattern can then be printed on the fabric. For instance, in one embodiment, a pattern can be printed onto the fabric using a rotary screen printing method. Once the pattern is applied to the fabric, the dye applied to the fabric during the printing process can be developed. In one embodiment, for instance, the fabric can be padded with a solution containing an alkali and reducing agent along with cornstarch. A steamer can drive a reaction that converts the dye into the reduced or leuco state. Once converted into a reduced form, the dyes, which may comprise vat dyes, become water soluble. After the dyes are reduced, the fabric goes through a rinse section before entering an oxidation step. For instance, the fabric can be contacted with an aqueous solution containing an oxidizing agent, such as a potassium iodide/acetic mixture. In another embodiment, hydrogen peroxide may be used as the oxidizing agent. Once oxidized, the dyes convert into their insoluble form and remain well affixed to the fabric.

In one embodiment, a camouflage pattern may be applied to the fabric, especially when the fabric is to be used in constructing military garments and/or hunting garments. A camouflage pattern, for instance, is intended to provide concealment properties to the wearer in both the human visible light range and the near infrared range. The camouflage pattern, for instance, may include at least 4 colors using dyes that in combination produce a range of reflectance values similar to that of the background environment in which the garment is to be used. In one embodiment, for instance, the dyes used to form the camouflage pattern may comprise low reflectance dyes that have a reflectance of less than about 70% over a range of wavelengths of from about 600 mm to about 1000 mm.

Fabrics made in accordance with the present disclosure exhibit sufficient flame resistant properties so as to protect a wearer against flash fires and electric arcs. For instance, one test for measuring the flame resistant properties of a fabric is known as the vertical flame test. The vertical flame test has been standardized as the ASTM D-6413 test. The test measures the vertical flame resistance of textiles. In particular, a specimen of a fabric is suspended vertically in a holder. A controlled flame is then impinged on the bottom cut edge of the fabric for 12 seconds. Upon removing the flame at the end of the 12 second period, different characteristics of the fabric are measured. The first characteristic is referred to as "after flame or glow" and represents the number of seconds during which there is a visible flame remaining on the fabric after the controlled flame has been removed. Further, the char length of the fabric can be measured which is the length of fabric destroyed by the flame that will readily tear by application of a standard weight. The third characteristic is any evidence of melting and dripping. In conducting the test, five specimens are tested in both the warp and weft directions and the results are averaged.

Fabrics made according to the present disclosure, for instance, when tested according to the vertical flame test (ASTM D6413) can be designed so as to exhibit a char length of less than about 4.5 inches in at least one direction or in both directions, have an after flame and after glow of less than about 2 seconds, such as 0 seconds, and exhibit substantially no dripping.

Of particular advantage, fabrics made according to the present disclosure can also display the above flame resistant properties even after being laundered multiple cycles. A standard laundry cycle, for instance, is described in U.S. Pat. No. 6,886,184, which is incorporated herein by reference. The laundry method is test AATCC 135, (1), IV, A, (1)-normal wash cycle, 120° F., tumble dry cotton sturdy cycle. During a laundry cycle, the fabric is washed in an automatic washer, followed by drying in an automatic dryer. Fabrics, made according to the present disclosure display relatively little decrease in their flame resistant properties even when subjected to 5 laundry cycles. For instance, fabrics made according to the present disclosure can exhibit the above described properties even after 5 laundry cycles.

Fabrics made in accordance with the present disclosure can also display excellent strength properties. For instance, when tested according to ASTM Test D 5034, the treated fabric can have a breaking strength in the warp direction of at least 135 lbs., such as at least 140 lbs., such as at least 150 lbs. The breaking strength at lighter weights is typically less than about 225 lbs. in the warp direction. In the fill direction, the breaking strength can be greater than about 100 lbs., such as greater than about 110 lbs. The breaking strength in the fill direction is generally less than about 150 lbs. When tested according to ASTM Test D 1424, the treated fabric can have a tear strength in the warp direction of greater than about 4.5 lbs., such as greater than about 5 lbs. The tear strength in the fill direction can be greater than about 4 lbs, such as greater than about 4.5 lbs. The tear strength in both the warp and the fill direction are generally less than about 10 lbs., such as less than about 8 lbs.

Fabrics constructed in accordance with the present disclosure can be used to construct numerous different types of products for use in various applications. In one embodiment, for instance, the fabrics can be used to produce garments including any suitable clothing articles. Due to the improved flame resistant properties, the fabrics are particularly well suited for constructing military garments, garments worn by firefighters and other security personnel including homeland security, and garments worn in industrial settings. Garments made according to the present disclosure may include shirts, pants, bib overalls, socks and other leg wear, gloves, scarves, hats, face shields, shoes, and the like.

For instance, in one embodiment, as shown in FIG. 1, the fabric can be used to produce a battle dress uniform 10. As shown, the battle dress uniform 10 can include a shirt or jacket 12, trousers 14, a hat 16, and boots 18. The fabric of the present disclosure can be used to produce any of these clothing articles.

As described above, when producing relatively lighter weight fabrics, the fabrics can be used to construct lightweight jackets and trousers, which may be incorporated into a clothing system. In one embodiment, for instance, the fabric can be used to produce Level V layers in an extended cold weather clothing system.

Figure 2:
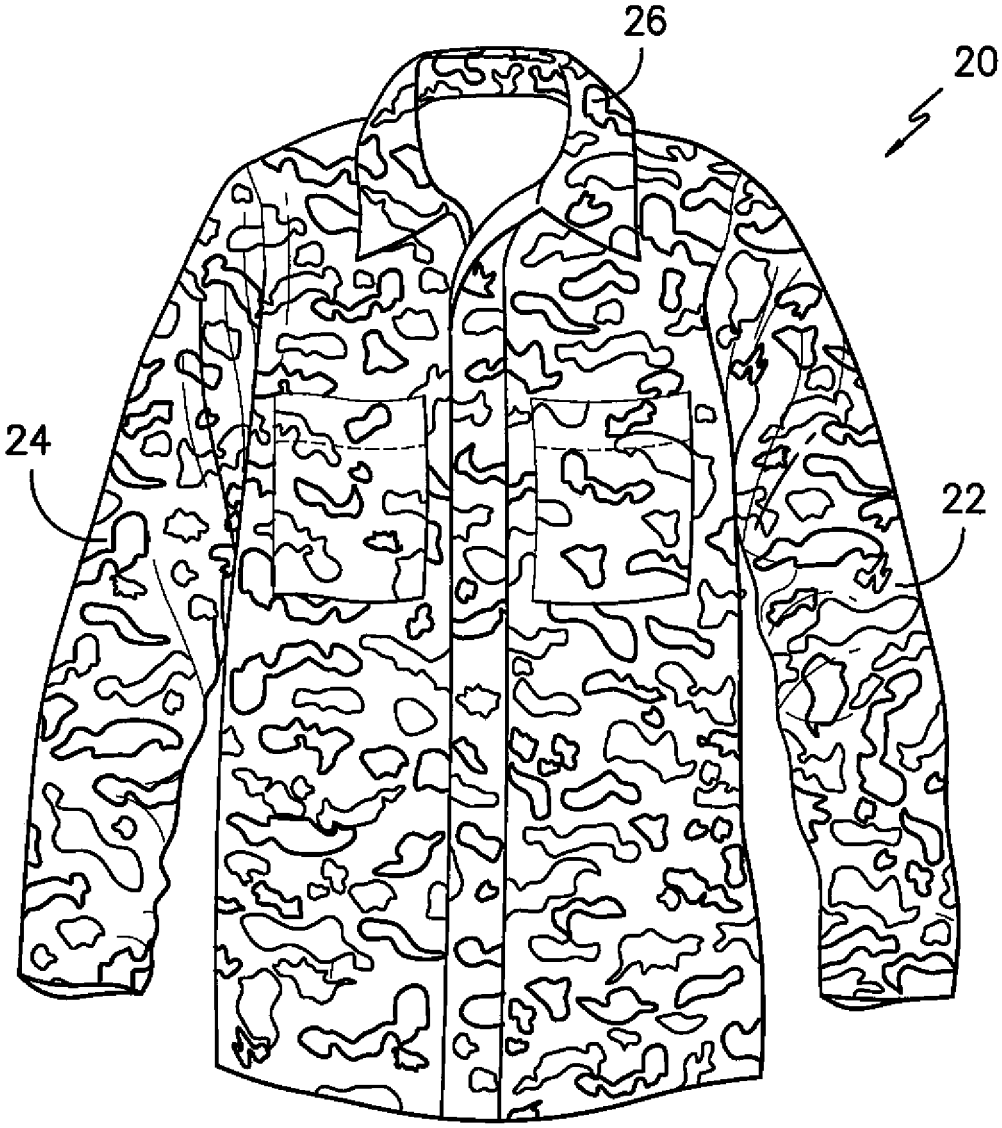
FIG. 2 is a perspective view of one embodiment of a jacket made in accordance with the present disclosure.

Referring to FIG. 2, for instance, a jacket 20 made in accordance with the present disclosure is shown. The jacket 20 includes sleeves 22 and 24 and a collar 26. In the embodiment illustrated, the jacket 20 includes a zipper. In other embodiments, however, the jacket may be designed to be pulled over the head of a user. The jacket may also include a hood that is unitary with the jacket body.

Figure 3:
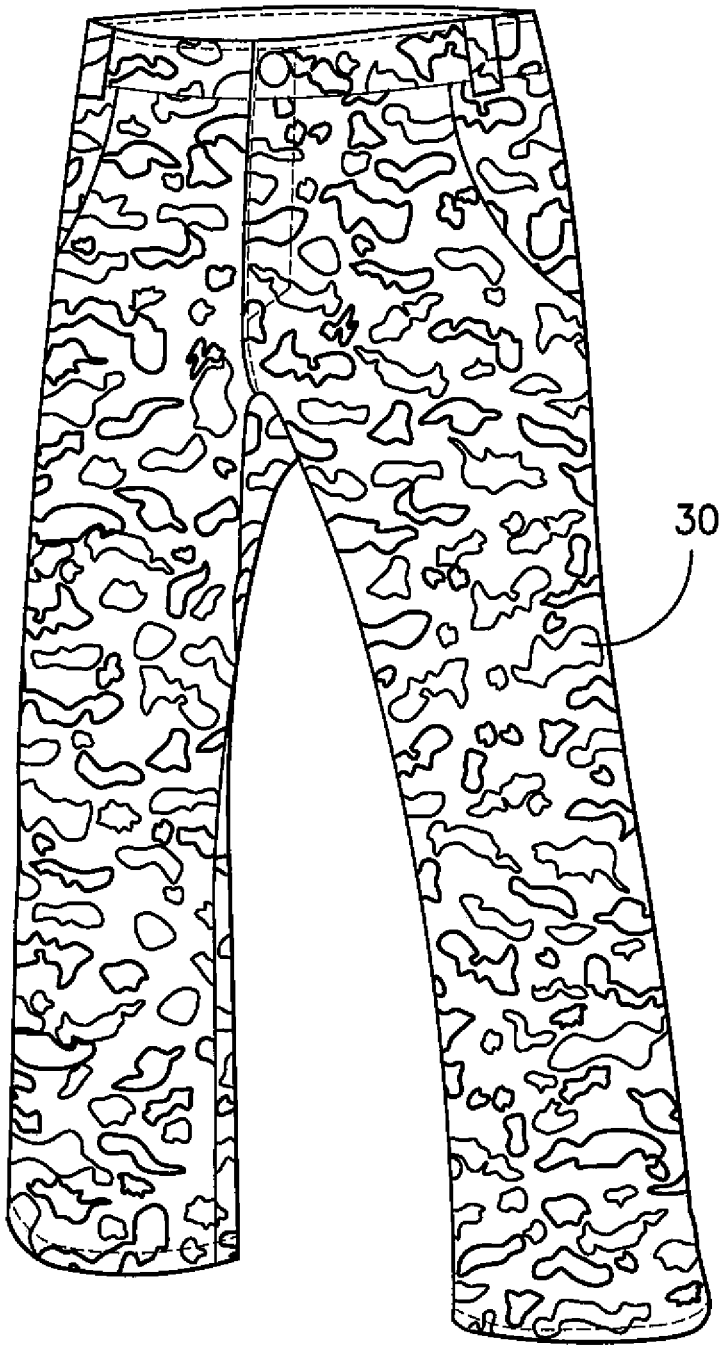
FIG. 3 is a perspective view of one embodiment of trousers made in accordance with the present disclosure.

Referring to FIG. 3, a pair of trousers 30 are shown which may be made in accordance with the present disclosure. The trousers 30 shown in FIG. 3 may be designed to be worn with the jacket 20 shown in FIG. 2.

The present disclosure may be better understood with reference to the following examples.

Example No. 1

Three fabrics were made according to the present disclosure containing the following fiber blend (Sample Nos. 1, 2 and 3):

6% by weight KEVLAR para-aramid fibers
32% by weight LENZING FR cellulose fibers
17% by weight nylon fibers
45% NOMEX meta-aramid fibers The above fiber blend was used to form yarns that were woven into the fabrics. The fabrics had a basis weight of 6.5 osy or 6.0 osy and had a herringbone or a twill weave.

Each of the above fabrics were then tested for abrasion resistance using ASTM Abrasion Test No. D3884 (2007 version using wheel H18 with 500 gram weight). For purposes of comparison, a commercially available fabric was also tested. The commercially available fabric was sold under the trade name DEFENDER M by Southern Mills Corporation. The commercially available fabric is believed to be made from the following fiber blend:

25% KEVLAR
65% LENZING
10% nylon

The following results were obtained:

| | Basis weight (osy) | Abrasion Resistance (cycles) | Weave |
|---|---|---|---|
| Sample No. 1 | 6.5 | 1300 | Twill |
| Sample No. 2 | 6.0 | 1500 | Twill |
| Sample No. 3 | 6.0 | 1700 | Herringbone |
| Comparative Sample | 6.2 | 500 | Rip stop |

As shown above, sample numbers 1-3, containing more than 10% by weight non-aromatic polyamide fibers, had dramatically better abrasion resistance characteristics than the comparative sample. In fact, the improvements in abrasion resistance are dramatic and unexpected in view of the relatively small difference in the amount of polyamide fibers present in the fabrics.

As shown above, a herringbone weave also dramatically improves abrasion resistance.

Example No. 2

The fabrics described in Example No. 1 above were also tested for other various properties. In particular, the fabrics were tested for various strength properties, shrink properties, and flame resistance.

The first test that was conducted was the "PYROMAN" Test. According to the PYROMAN Test, a fully instrumented, life-sized mannequin is donned with clothing and put into a fire resistant room. The mannequin and clothing are exposed to flash fire conditions. In one test, the mannequin is equipped with over a hundred heat sensors uniformly distributed over the surface of the mannequin. Eight industrial burners produce a flash fire for a certain period of time, usually 4 seconds. The fire fully engulfs the mannequin. The sensors send information to a computer system which then predicts the amount of burns a person would have suffered. In particular, the computer system reports a predicted burn injury over the surface of the mannequin. A calculated incident heat flux is used to calculate the temperature of human tissue at two depths below the surface of the skin, one representing second degree and the other representing third degree burn injury.

In this example, the fabric described under Sample No. 3 in Example 1 above and the Comparative sample were placed on the mannequin. In particular, the fabrics were made into battle dress uniforms such as those that would be worn by the military. The shirt was left untucked from the pants in order to better simulate real life conditions. The following results were obtained:

| Total Burn Injury Prediction 2 cal/(cm$^2$ * sec) - 4 seconds | | |
|---|---|---|
| Average of 3 Tests | Comparative Sample | Sample No. 3 |
| 2nd Degree Burn | 23% | 25% |
| 3rd Degree Burn | 27% | 10% |
| Total Burn Injury Prediction | 50% | 35% |

As shown above, the fabric of the present invention had a 30% reduction in total body burns and a 63% reduction in predicted third degree burns.

In addition to the PYROMAN Test as described above, the following tests were also conducted on the fabrics and the following results were obtained:

| Test Description | Test Method | Unit | Sample No. 3 | Sample No. 2 | Sample No. 1 | Comparative Sample |
|---|---|---|---|---|---|---|
| | | | Values (Warp × Fill) | | | |
| COMFORT | | | | | | |
| Thickness of Textile Materials | ASTM D 1777 | Inch | 0.018 | 0.017 | 0.017 | 0.013 |
| Air Permeability of Textile Fabrics | ASTM D 737 | CFM | 35 | 28 | 13 | 41 |
| Water Vapor Transmission of Materials | ASTM E 96 | G/M2/24H | 982 | 947 | 995 | 930 |
| Stiffness of Fabric (Circular Bend Procedure) | ASTM D 4032 | Pounds | 0.5 × 0.5 | 0.5 × 0.5 | 0.6 × 0.6 | 0.6 × 0.7 |
| Wicking of Fabrics and Fibrous Materials - after 5 MN | SAE J913 | Inch | 1.5 × 1.5 | 1.8 × 1.3 | 1.5 × 1.5 | 1.5 × 1.25 |
| Drying Time | USMC | Minutes | 35 | 35 | 40 | 50 |
| STRENGTH | | | | | | |
| Breaking Strength of Textile Fabrics (Grab Test) | ASTM D 5034 | Pounds | 206 × 139 | 205 × 126 | 211 × 157 | 146 × 120 |
| Hydraulic Bursting Strength of Fabrics (Diaphragm Bursting Tester - Mullen) | ASTM D 3786 | PSI | 220 | 220 | 230 | 130 |
| Tearing Strength of Fabrics (Falling-Pendulum Type (Elmendorf) Apparatus) | ASTM D 1424 | Pounds | 11 × 10 | 15 × 10 | 9 × 9 | 12 × 10 |
| Tearing Strength of Fabrics (Tongue (Single Rip) Procedure) | ASTM D 2261 | Pounds | 16 × 10 | 12 × 10 | 11 × 9 | 11 × 11 |
| Tearing Strength of Fabrics (Trapezoid Procedure) | ASTM D 5587 | Pounds | 41 × 22 | 39 × 23 | 35 × 23 | 15 × 10 |
| DURABILITY | | | | | | |
| Dimensional Changes after Commercial Laundering - after 5 Launderings | AATCC 96 | Percent | 2.8 × 1.7 | 2.5 × 2.3 | 3.9 × 2.3 | 2.4 × 1.5 |
| Dimensional Changes after Home Laundering - after 5 Launderings | AATCC 135 | Percent | 3 × 3 | 4 × 1 | 4 × 3 | 2.1 × 1.5 |
| HEAT & FLAME PROTECTION | | | | | | |
| Heat and Thermal Shrinkage Resistance ? after 5 Minutes at 500° F. | NFPA 1971 8.6 | Percent | 5 × 4.5 | 4 × 2 | 3 × 2 | 3.0 × 3.0 |
| Flame Resistance of Textiles (Vertical Test) - After Flame | ASTM D 6413 | Seconds | 0 × 0 | 0 × 0 | 0 × 0 | 0 × 0 |
| Flame Resistance of Textiles (Vertical Test) - After Glow | ASTM D 6413 | Seconds | 7 × 8 | 7 × 7 | 8 × 6 | 2 × 2 |
| Flame Resistance of Textiles (Vertical Test) - Char Length | ASTM D 6413 | MM | 50 × 43 | 55 × 41 | 60 × 40 | 78 × 65 |
| Flame Resistance of Textiles (Vertical Test) - Drip | ASTM D 6413 | Count | 0 × 0 | 0 × 0 | 0 × 0 | 0 × 0 |
| Flame Resistance of Textiles (Vertical Test) - After Flame after 25 Home Launderings | ASTM D 6413 (AATCC 135) | Seconds | 0 × 0 | 0 × 0 | 0 × 0 | 0 × 0 |
| Flame Resistance of Textiles (Vertical Test) - After Glow after 25 Home Launderings | ASTM D 6413 (AATCC 135) | Seconds | 7 × 7 | 7 × 7 | 7 × 6 | 2 × 2 |

-continued

| Test Description | Test Method | Unit | Sample No. 3 | Sample No. 2 | Sample No. 1 | Comparative Sample |
|---|---|---|---|---|---|---|
| | | | Values (Warp × Fill) | | | |
| Flame Resistance of Textiles (Vertical Test) - Char Length after 25 Home Launderings | ASTM D 6413 (AATCC 135) | MM | 38 × 45 | 45 × 45 | 51 × 45 | 63 × 63 |
| Flame Resistance of Textiles (Vertical Test) - Drip after 25 Home Launderings | ASTM D 6413 (AATCC 135) | Count | 0 × 0 | 0 × 0 | 0 × 0 | 0 × 0 |
| Fabric Break Open | MIL-C-83429B | Seconds | 31 | 31 | 31 | 31 |
| Thermal Protective Performance (TPP No Spacer) | NFPA 1971 8.10 | Square Seconds | 8.3 | 8.0 | 8.0 | |

Example No. 3

The following are fabrics made in accordance with the present disclosure.

Sample No. 4

Warp yarn and fill yarn: Same fiber blend as described in Example No. 1 above having a size of 36/2

Ends: 56.5 yarns per inch

Picks: 50 yarns per inch

Weight: 4.75 osy after printing

Weave: Plain weave

Coated with FR polyurethane in an amount of about 1 osy

Sample No. 5

Warp yarn and fill yarn: Same fiber blend as described in Example No. 1 above having a size of 30/1

Ends: 62 yarns per inch

Picks: 62 yarns per inch

Weight: 3 osy after printing

Weave: Rip stop

Laminated to an expanded polytetrafluoroethylene film and to a tricot knit fabric resulting in a laminate having an air permeability of 0 cfm Sample No. 6

Warp yarn and fill yarn: Same fiber blend as described in Example No. 1 above having a size of 30/1

Ends: 90 yarns per inch

Picks: 82 yarns per inch

Weight: 4.11 osy after printing

Weave: Plain weave

The fabric was treated with a durable water resistant finish and calendered to result in air permeability of less than 15 cfm. The above fabric is well suited to producing a wind resistant shirt also possessing flame resistance.

Sample No. 7

Warp yarn: FR polyester filament 2/70/68 air jet textured

Fill yarn: Same fiber blend as described in Example No. 1 having a size of 30/1

Ends: 102 yarns per inch

Picks: 84 yarns per inch

Weave: 2×1 twill weave

The twill weave placed the spun yarns predominately on one side of the fabric and the polyester yarns on predominately the other side of the fabric. When formed into a garment, the fill yarns may be placed adjacent to the body of the wearer.

Sample No. 4 above was subjected to various tests and the following results were obtained.

| TEST METHOD | TEST_NAME | UNIT | Sample No. 4 |
|---|---|---|---|
| AATCC 135 | SHRINK FILL | PERCENT | 0.3 |
| | SHRINK WARP | PERCENT | 2.6 |
| ASTM D 3776 | WEIGHT (TOTAL) | OZ_SQ_YD | 5.69 |

-continued

| TEST METHOD | TEST_NAME | UNIT | Sample No. 4 |
|---|---|---|---|
| ASTM D 5034 | BREAK STRENGTH FILL | POUNDS | 116 |
| | BREAK STRENGTH WARP | POUNDS | 157 |
| | ELONGATION AT BREAK FILL | PERCENT | 49 |
| | ELONGATION AT BREAK WARP | PERCENT | 23 |
| ASTM D 1424 | TEARING STRENGTH FILL | POUNDS | 4.9 |
| | TEARING STRENGTH WARP | POUNDS | 5.7 |
| ASTM E 96B | MOISTURE VAPOR TRANSMISSION RATE | $G/M^2/24$ HRS | 700 |
| ASTM D 747 | STIFFNESS AT 70° C. | INCH LB | 0.0010 |
| | STIFFNESS AT 32° C. | INCH LB | 0.0012 |
| AATCC 127 | WATER PERMEABILITY (INITIAL) | CM | 23.7 |
| AATCC 22 | SPRAY RATING (INITIAL) | | 100 |
| | SPRAY RATING AFTER 5 LAUNDERINGS | | 100 |
| ASTM D 6413 | AFTER FLAME FILL | SECONDS | 0 |
| | AFTER FLAME WARP | SECONDS | 0 |
| | AFTER GLOW FILL | SECONDS | 0 |
| | AFTER GLOW WARP | SECONDS | 0 |
| | CHAR LENGTH FILL | MM | 3.5 |
| | CHAR LENGTH WARP | MM | 3.6 |
| ASTM D 6413 (AATCC 135) | AFTER FLAME FILL 5X | SECONDS | 0 |
| | AFTER FLAME WARP 5X | SECONDS | 0 |
| | AFTER GLOW FILL 5X | SECONDS | 0 |
| | AFTER GLOW WARP 5X | SECONDS | 0 |
| | CHAR LENGTH FILL 5X | MM | 3.4 |
| | CHAR LENGTH WARP 5X | MM | 3.7 |
| ASTM D 737 | AIR PERMEABILITY | CFM | <0.1 |
| NFPA 1971 8.6 | THERMOSTABILITY FILL | PERCENT | 1.7 |
| | THERMOSTABILITY WARP | PERCENT | 6.5 |
| | THERMOSTABILITY AFTER 5 LAUNDERINGS FILL | PERCENT | 3.7 |
| | THERMOSTABILITY AFTER 5 LAUNDERINGS WARP | PERCENT | 5.7 |
| ISO 17492 | TPP-UNSPACED-INITIAL | RATING | 8.7 |
| | TPP-UNSPACED-AFTER 5 LAUNDERINGS | RATING | 8.9 |
| | TPP-SPACED-INITIAL | RATING | 11.6 |
| | TPP-SPACED-AFTER 5 LAUNDERINGS | RATING | 12.4 |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A garment with flame resistant properties comprising;

a fabric shaped to cover at least a portion of a wearer's body, the fabric comprising a woven fabric made from a plurality of yarns, the fabric having a basis weight of less than about 5 osy, the yarns being made from a plurality of fibers, the plurality of fibers including:

meta-aramid fibers in an amount from about 30% to about 60% by weight of the fabric;

flame resistant cellulose fibers, the flame resistant cellulose fibers being present in the fabric in an amount from about 20% to about 50% by weight;

non-aromatic polyamide, the non-aromatic polyamide being present in an amount from about 12% to about 25% by weight; and optionally para-aramid fibers, the para-aramid fibers being present in an amount up to about 15% by weight of the fabric.

2. A garment as defined in claim 1, wherein the fabric contains para-aramid fibers in an amount from about 3% to about 15% by weight of the fabric.

3. A garment as defined in claim 1, wherein the yarns contained within the woven fabric are made from an intimate blend of the meta-aramid fibers, the flame resistant cellulose fibers, the non-aromatic polyamide, and optionally the para-aramid fibers.

4. A garment as defined in claim 1, wherein the flame resistant cellulose fibers comprise cotton or rayon fibers pre-treated with a fire resistant composition.

5. A garment as defined in claim 1, wherein the woven fabric contains about 40% to about 50% by weight meta-aramid fibers, from about 15% to about 20% by weight non-aromatic polyamide, from about 30% to about 35% by weight flame resistant cellulose fibers, and from about 3% to about 8% by weight para-aramid fibers.

6. A garment as defined in claim 1, wherein the woven fabric has a basis weight of from about 2 osy to about 5 osy.

7. A garment as defined in claim 1, wherein the garment defines an exterior surface and wherein a camouflage pattern has been applied to the exterior surface of the garment.

8. A garment as defined in claim 1, wherein the fabric has been treated with a flame resistant polymer composition, the flame resistant polymer composition having a weight on the fabric of from about 0.25 osy to about 2 osy.

9. A garment as defined in claim 8, wherein the flame resistant polymer composition comprises a polyurethane polymer.

10. A garment as defined in claim 1, wherein the woven fabric has a warp direction and a fill direction, the warp direction and the fill direction both having a yarn density of from about 45 yarns per inch to about 95 yarns per inch.

11. A garment as defined in claim 8, wherein the woven fabric has a warp direction and a fill direction, the warp direction and the fill direction both having a yarn density of from about 45 yarns per inch to about 95 yarns per inch, and wherein the treated fabric has an air permeability of less than 1 cfm according to ASTM Test D 737, has a water permeability of greater than about 20 cm when tested according to AATCC 127, and has a char length of less than 4.5 cm when tested according to the ASTM Vertical Flame Test D 6413.

12. A garment as defined in claim 1, wherein the fabric has a warp direction and a fill direction and wherein both the warp direction and the fill direction have a yarn density of from about 55 yarns per inch to about 70 yarns per inch, the fabric being treated with a durable water-resistant finish.

13. A garment as defined in claim 1, wherein the fabric has a warp direction and a fill direction and wherein both the warp direction and the fill direction have a yarn density of from about 50 yarns per inch to about 70 yarns per inch, the fabric being laminated to a film, the film comprising a polyurethane polymer or an expanded polytetrafluoroethylene.

14. A garment as defined in claim 1, wherein the yarns have a size of from about 40/1 to about 15/1.

15. An article of clothing comprising a jacket or trousers, the article of clothing comprising a woven or knitted fabric constructed from yarns, the yarns comprising an intimate blend of inherently flame resistant fibers and flame resistant cellulose fibers, the flame resistant cellulose fibers being present in the fabric in an amount of at least about 20% by weight, the fabric including a first side and an opposite second side, the first side of the fabric defining an exterior surface of the article of clothing, the first side of the fabric being treated with a flame resistant polymer composition, the fabric having a basis weight of less than about 5 osy, the flame resistant polymer composition being present on the fabric in an amount from about 0.25 osy to about 2 osy, wherein the woven fabric has a warp direction and a fill direction, the warp direction and the fill direction both having a yarn density of from about 45 yarns per inch to about 95 yarns per inch, and wherein the treated fabric has an air permeability of less than 1 cfm according to ASTM Test D 737, has a water permeability of greater than about 20 cm when tested according to AATCC 127, and has a char length of less than 4.5 cm when tested according to the ASTM Vertical Flame Test D 6413.

16. An article of clothing as defined in claim 15, wherein the yarns contained in the fabric comprise meta-aramid fibers in an amount from about 30% to about 60% by weight of the fabric;

flame resistant cellulose fibers, the flame resistant cellulose fibers being present in the fabric in an amount from about 20% to about 50% by weight;

non-aromatic polyamide, the non-aromatic polyamide being present in an amount from about 12% to about 25% by weight; and para-aramid fibers, the para-aramid fibers being present in an amount from about 3% to about 15% by weight.

17. An article of clothing as defined in claim 15, wherein the flame resistant polymer composition comprises a polyurethane polymer.

18. An article of clothing as defined in claim 15, wherein the woven fabric has a warp direction and a fill direction, the warp direction and the fill direction both having a yarn density of from about 45 yarns per inch to about 95 yarns per inch.

19. An article of clothing as defined in claim 15, wherein the yarns have a size of from about 40/1 to about 15/1.

20. An article of clothing as defined in claim 15, wherein the garment defines an exterior surface and wherein a camouflage pattern has been applied to the exterior surface of the garment.

21. An article of clothing as defined in claim 15, wherein the fabric has a basis weight of from about 4 osy to about 5 osy and wherein the flame resistant polymer composition is present on the fabric at a weight of from about 0.75 osy to about 1.5 osy.

22. An article of clothing as defined in claim 15, wherein the woven fabric has a warp direction and a fill direction, the warp direction and the fill direction both having a yarn density of from about 45 yarns per inch to about 60 yarns per inch.

23. An article of clothing as defined in claim 15, wherein the treated fabric has a moisture vapor transmission rate of greater than about 600 $g/m^2/24$ hrs when tested according to ASTM Test E 96B.

24. An article of clothing as defined in claim 15, wherein the fabric has a breaking strength in a warp direction of greater than about 140 lbs. when tested according to ASTM Test D 5034 and has a tear strength in the warp direction of greater than about 5 lbs. when tested according to ASTM Test D 1424.

25. An extended cold weather clothing system that includes seven layers of clothing, the extended cold weather clothing system including the article of clothing defined in claim 15.

* * * * *